US009580216B2

(12) United States Patent
Wisniewski

(10) Patent No.: US 9,580,216 B2
(45) Date of Patent: Feb. 28, 2017

(54) CONTAINER CLOSURE FOR VENTED POURING THROUGH AN ELONGATE APERTURE

(75) Inventor: John M. Wisniewski, Wauwatosa, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 14/380,896

(22) PCT Filed: May 2, 2012

(86) PCT No.: PCT/US2012/036041

§ 371 (c)(1),
(2), (4) Date: Aug. 25, 2014

(87) PCT Pub. No.: WO2013/165404

PCT Pub. Date: Nov. 7, 2013

(65) Prior Publication Data

US 2015/0048124 A1 Feb. 19, 2015

(51) Int. Cl.
*B67D 3/00* (2006.01)
*B65D 51/16* (2006.01)
(Continued)

(52) U.S. Cl.
CPC ..... *B65D 51/16* (2013.01); *B65D 47/0809* (2013.01); *B65D 47/32* (2013.01);
(Continued)

(58) Field of Classification Search
CPC .... B65D 51/16; B65D 51/18; B65D 47/0804; B65D 47/0809; B65D 47/32; B65D 2205/02; B67D 3/00
(Continued)

(56) References Cited

U.S. PATENT DOCUMENTS 3,059,816 A 10/1962 Goldstein
3,750,915 A 8/1973 Kearney
(Continued)

FOREIGN PATENT DOCUMENTS

CA 2567706 A1 5/2008
GB 412863 A * 7/1934 ..... B65D 47/06
WO WO 2011/149476 * 12/2011 ..... B67D 3/00

OTHER PUBLICATIONS

The "International Search Report and the Written Opinion of the International Searching Authority, or the Declaration" dated "Jul. 6, 2012" for the International Application No. PCT/US2012/036041 of which the above-captioned instant U.S. patent application Serial No. (not yet designated) is a U.S. national phase application.

*Primary Examiner* — Kevin P Shaver
*Assistant Examiner* — Jeremy W Carroll
(74) *Attorney, Agent, or Firm* — Wood, Phillips, Katz, Clark & Mortimer

(57) ABSTRACT

A closure (20, 20A) is provided for a container that has an opening to the container interior wherein contents may be stored. The closure (20, 20A) includes the following: (A) a closure body (30, 30A) defining (i) a pour aperture (50) that can communicate-with the container opening and that can accommodate pouring out of the contents through the pour aperture (50), and (ii) at least one vent aperture (60) that can communicate with the container opening and that can accommodate the in-venting of ambient atmosphere through the vent aperture (60) into the container, and (B) a lid (32, 32A) for closing the closure (20, 20A). The pour aperture (50) has an elongate configuration oriented along a central axis line (A) that bisects the pour aperture (50) and closure body (30).

8 Claims, 11 Drawing Sheets

(51) Int. Cl.
*B65D 47/08* (2006.01)
*B65D 47/32* (2006.01)
*B65D 51/18* (2006.01)

(52) U.S. Cl.
CPC ..... *B65D 51/18* (2013.01); *B67D 3/00* (2013.01); *B65D 2205/02* (2013.01)

(58) Field of Classification Search
USPC ..... 222/478
See application file for complete search history.

(56) References Cited

U.S. PATENT DOCUMENTS

| | | | | |
|---|---|---|---|---|
| 4,241,855 | A | 12/1980 | Yoshioka | |
| 4,452,381 | A | 6/1984 | Freeman | |
| 5,289,950 | A * | 3/1994 | Gentile | 222/142.3 |
| 5,605,254 | A | 2/1997 | Wagner, III et al. | |
| 6,230,944 | B1 | 5/2001 | Castellano et al. | |
| 6,367,670 | B1 * | 4/2002 | Warner et al. | 222/556 |
| 6,926,179 | B2 | 8/2005 | Wagner, III et al. | |
| 7,048,158 | B2 * | 5/2006 | Hierzer | B65D 47/0814 215/235 |
| D614,488 | S | 4/2010 | Kallenbach et al. | |
| 2009/0242564 | A1 | 10/2009 | Danks et al. | |
| 2011/0284541 | A1 * | 11/2011 | Webster et al. | 220/288 |
| 2012/0074180 | A1 * | 3/2012 | Kallenbach et al. | 222/567 |
| 2013/0037510 | A1 * | 2/2013 | Tamarit Rios | 215/259 |
| 2013/0056501 | A1 * | 3/2013 | Beilke et al. | 222/478 |

* cited by examiner

CONTAINER CLOSURE FOR VENTED POURING THROUGH AN ELONGATE APERTURE

TECHNICAL FIELD

This invention relates to container closures.

BACKGROUND OF THE INVENTION AND TECHNICAL PROBLEMS POSED BY THE PRIOR ART

Various flowable substances (including liquids) may be packaged in a rigid, flexible, or collapsible container (e.g., bottle, pouch, etc.) having a closure that can be opened to allow the contents to be poured out. The container with the closure mounted thereon and the contents stored therein may be characterized as a "package."

The inventors of the present invention have invented a novel structure for a container closure wherein the closure includes advantageous features not heretofore taught or contemplated by the prior art.

SUMMARY OF THE INVENTION

According to broad aspects of one form of the invention, a closure is provided for a container that has an opening to the container interior wherein contents may be stored. The closure includes a body that is either (a) a separate structure for being attached to the container at the opening, or (b) a structure formed as a unitary portion of the container at the opening.

The closure body has a deck defining (a) a pour aperture that can communicate with the container opening and that can accommodate pouring out of the contents through the pour aperture, and (b) at least one vent aperture that can communicate with the container opening and that can accommodate the in-venting of ambient atmosphere through the at least one vent aperture into said container.

The closure body has a spout projecting outwardly from the deck and extending at least partway around the pour aperture.

The closure also includes a lid for accommodating movement relative to the closure body between (a) a closed position sealing against the closure body to prevent flow of the contents outwardly of the closure body, and (b) an open position permitting flow of the contents outwardly of the closure body.

The pour aperture is elongate with its length oriented along a central axis line that bisects the closure body and the pour aperture. The pour aperture has an arcuate narrow end, and the pour aperture has a wide end that (a) is wider than the narrow end, and (b) is located closer to the at least one vent aperture than is the narrow end. The at least one vent aperture has a maximum width as measured along a line perpendicular to the closure body central axis line, and the maximum width of the at least one vent aperture is greater than the width of at least a portion of the pour aperture as the pour aperture width is measured along a line perpendicular to the closure body central axis line. The length of the pour aperture is at least three times greater than the maximum width of the pour aperture as the pour aperture maximum width is measured along a line perpendicular to the closure body central axis line.

The closure can be provided with a design that accommodates efficient, high quality, large volume manufacturing techniques with a reduced product reject rate.

The closure can optionally be designed to accommodate its use with a variety of conventional or special containers having a variety of conventional or special container finishes (e.g., snap-fit attachment configurations, thermal bonding configurations. etc.).

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
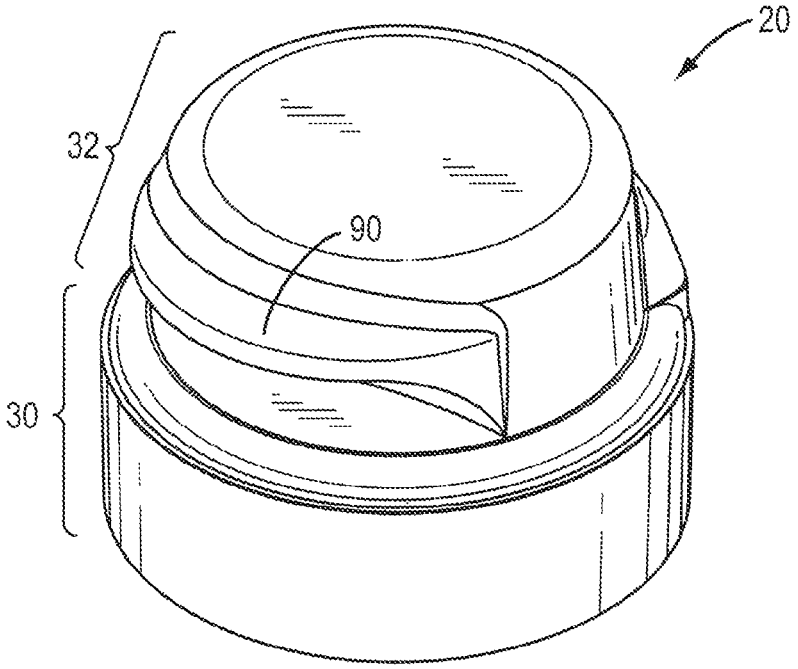
FIG. 1 is an isometric view, taken from the front and right side, of a first embodiment of a closure of the present invention with the closure in the closed condition (prior to installation on a container (not shown) filled with contents to define a package)
Figure 2:
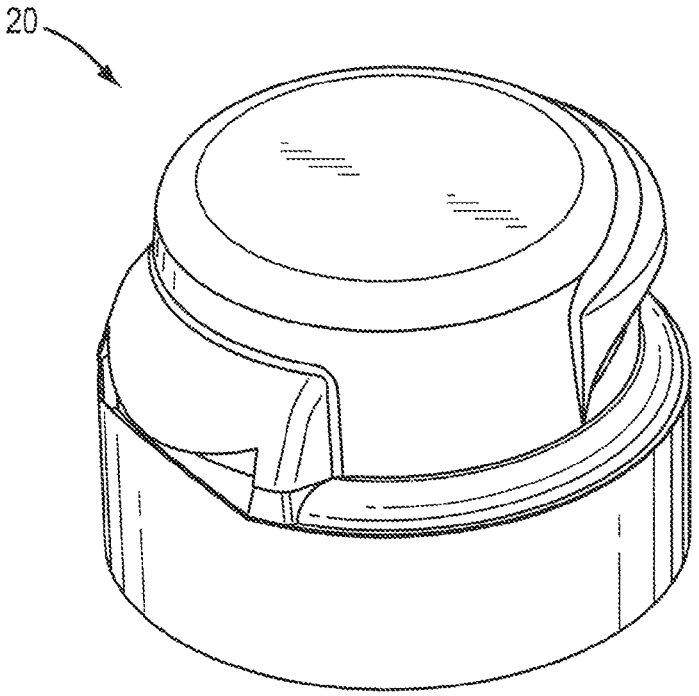
FIG. 2 is an isometric view of the first embodiment of the closed closure from the rear and left side.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, many of the figures illustrating the invention show the embodiments of the closure of this invention in the typical orientation that the closure would have at the top of a container (not shown) when the container is oriented upright, and terms such as upper, lower, horizontal, etc., are used with reference to this orientation. It will be understood, however, that the closure of this invention may be manufactured, stored, transported, used, and sold in an orientation other than the orientations described.

The closure of this invention is suitable for use with a variety of conventional or special containers, the details of which, although not fully illustrated or described, would be apparent to those having skill in the art and an understanding of such containers. The particular containers, per se, that are illustrated and described herein form no part of, and therefore are not intended to limit, the present invention. It will also be understood by those of ordinary skill that novel and non-obvious inventive aspects are embodied in the described exemplary closures alone.

The closure will typically be used on a container that contains a flowable product (e.g., a liquid, cream, slurry, etc.) in the form of a fluent substance that can be poured from the container through the opened closure. Such a fluent substance may be sold, for example, as a food product (e.g. soy sauce), a personal care product, an industrial product, a household product, or other types of products. Such substances may be for internal or external use by humans or animals, or for other uses (e.g., activities involving medicine, manufacturing, commercial or household maintenance, construction, agriculture, etc.).

A first embodiment of a closure of the present invention is illustrated in the Figures wherein the closure is designated generally by reference number 20. In the illustrated first embodiment, the closure 20 is provided in the form of a separate closure 20 which is adapted to be mounted on, or otherwise attached to, a container (not shown) that would typically contain contents such as a product consisting of a fluent substance. The container typically has a top portion extending upwardly to define an opening to the container interior and may be formed from a material suitable for the intended application (e.g., molded polyethylene or polypropylene).

It is contemplated that typically, after the closure manufacturer makes the closure 20 (e.g., by molding the closure 20 from a thermoplastic polymer), the closure manufacturer will then ship the closure 20 to a container filler facility at another location where the container is either manufactured or otherwise provided, and where the container is filled with a product prior to installation of the closure 20 on the filled container.

In the illustrated embodiments, the closure is provided as a separately manufactured article, component, or unit for being removably or non-removably attached (e.g., mounted or installed) on a container. Further, it may be desirable for the closure (or at least a base portion of the closure) to be formed as a unitary part, or extension, of the container wherein such a unitary part or extension may also be characterized as simultaneously defining an end structure of the container, per se.

The illustrated preferred embodiments of the closures are initially formed separately from the container, and are adapted to be attached to the container at an opening which provides access to the container interior and to the contents (e.g., a product contained therein) after a portion of the closure is opened.

The container, per se, does not form a part of the broadest aspects of the closure of the present invention, per se. The container may have any suitable configuration. With those forms of the closure of the present invention wherein the closure is a separately formed article, the container typically includes an upper end portion (or other suitable structure on some part of the container) that defines the container mouth or opening, and such a container opening portion or structure has a cross-sectional configuration with which the closure is adapted to engage. The main body portion of the container may have another cross-sectional configuration that differs from the cross-sectional configuration of the container at the container opening. On the other hand, the container may instead have a substantially uniform shape along its entire length or height without any portion of reduced size or different cross-section.

The container may have a generally rigid wall or walls which can be grasped by the user. The illustrated embodiments of the closure are also suitable for use with a container having a flexible wall or walls.

Figure 8:
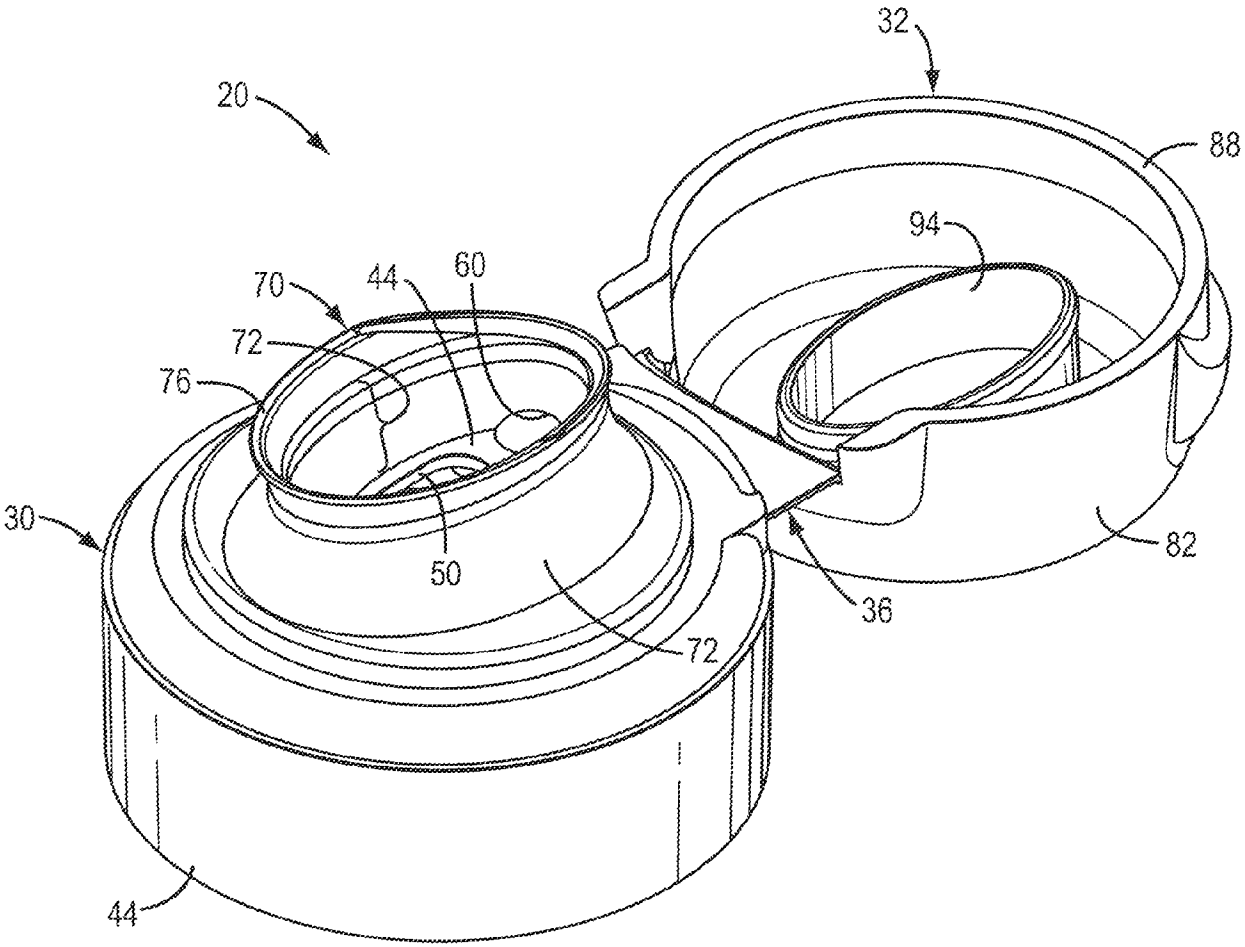
FIG. 8 is an isometric view from the upper, right front corner of the first embodiment of the closure shown in FIG. 1, but in FIG. 8 the lid is open.
Figure 9:
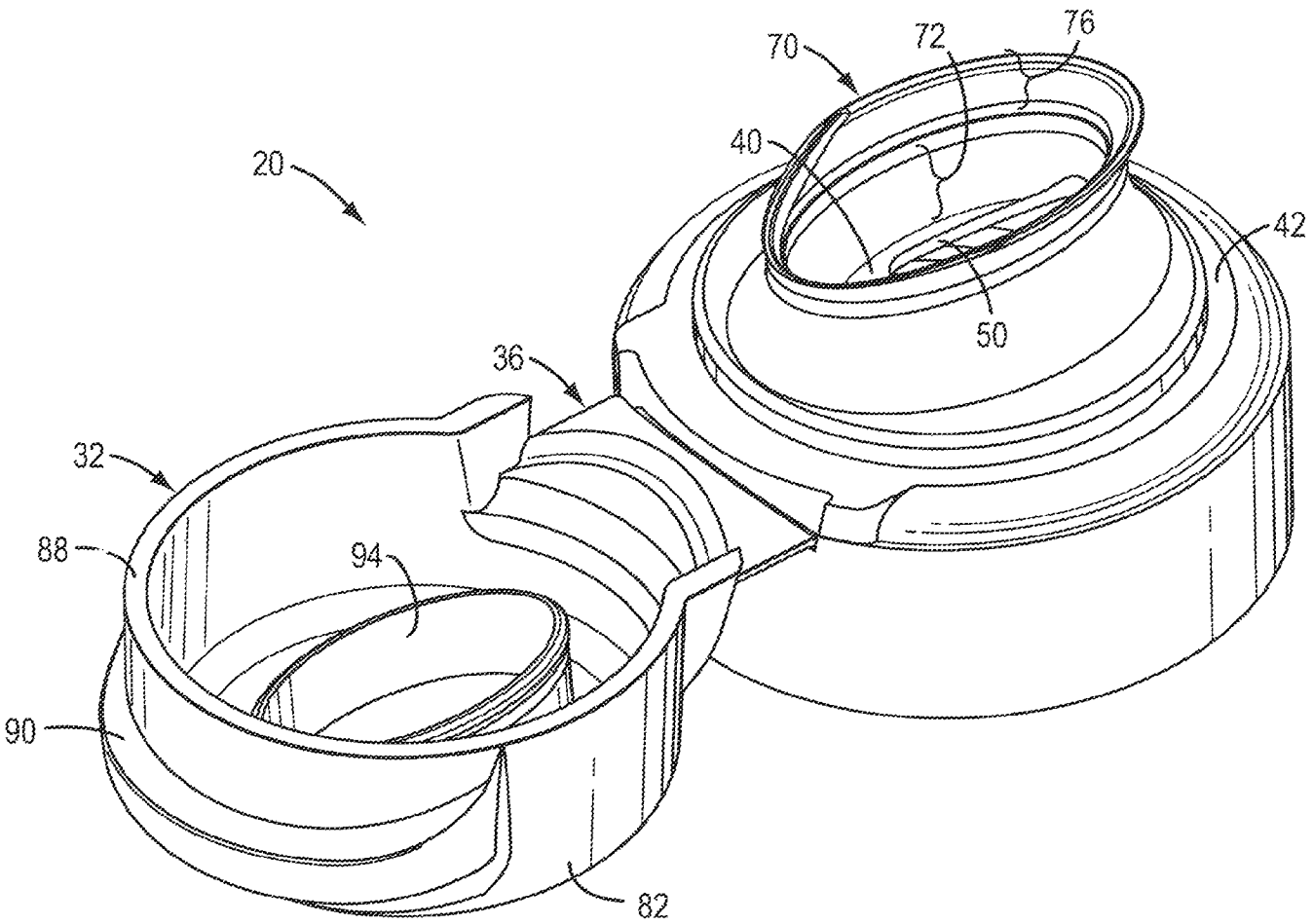
FIG. 9 is an isometric view from the upper, left rear corner of the first embodiment of the closure shown in FIG. 2, but in FIG. 9 the lid is open.

As seen in FIG. 8, the first embodiment of the closure 20 includes (A) a body 30 (which may be characterized as defining a peripheral wall, base, or other analogous structure intended to be located at the top of the container), (B) a lid 32 (i.e., cap or cover), and (C) a hinge 36 joining the lid 32 to the body 30. In the illustrated, preferred first embodiment of the closure 20, the closure body 30, lid 32, and hinge 36 are molded together as a unitary structure from a suitable thermoplastic material such as polypropylene or the like. Other materials may be employed instead. In the illustrated embodiment, the closure 20 is initially molded as a completely separate article that is subsequently attached to the container (not shown) after the container has been initially filled with a product.

In alternate designs (not illustrated), the closure 20 could be made from a plurality of separate parts that are assembled together.

Figure 11:
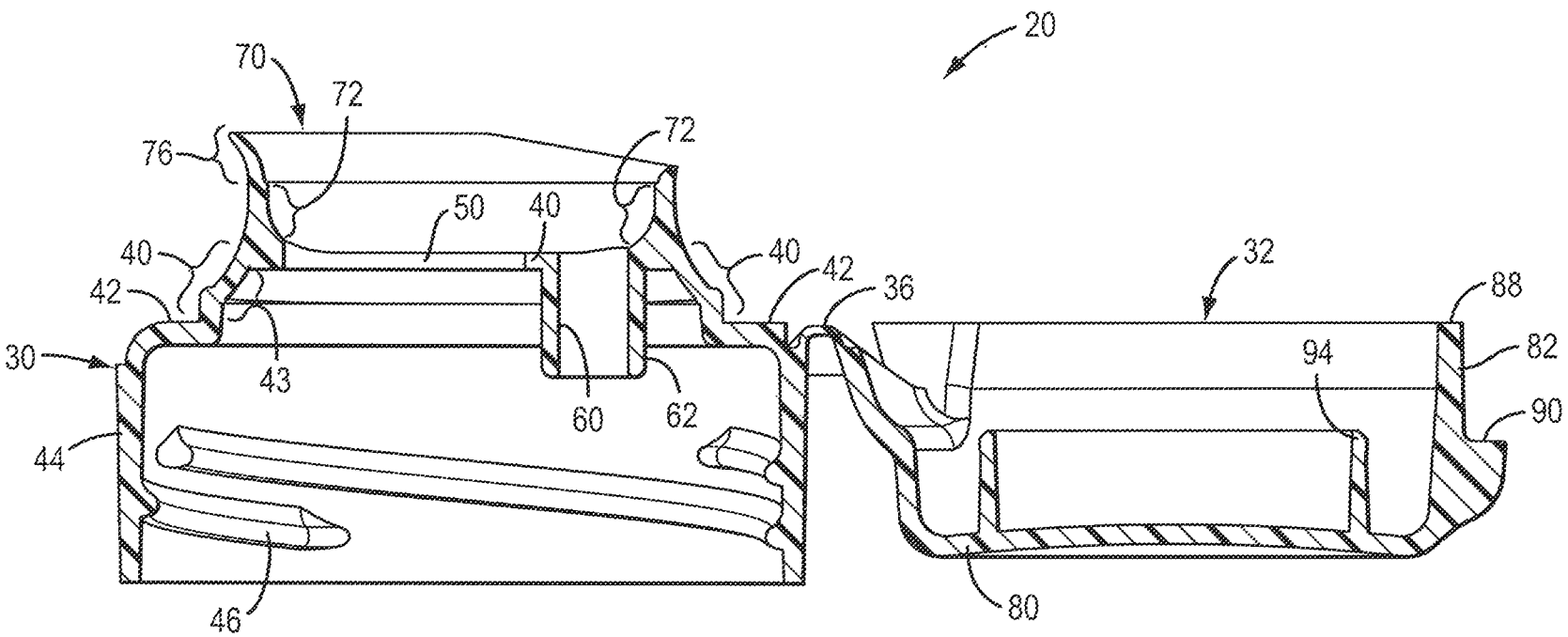
FIG. 11 is a cross-sectional view taken generally along the plane 11-11 in FIG. 10.

As can be seen in FIG. 11, the closure body 30 includes an upper deck which can also be characterized as an inner deck 40. As can be seen in FIG. 11, the inner deck 40 includes (1) a generally flat interior portion, and (2) a downwardly extending peripheral portion (43). As can be seen in FIG. 11, the body 30 has a lower, outer deck 42 which extends outwardly from, and surrounds, the peripheral portion 43 of the inner deck 40.

Figure 3:
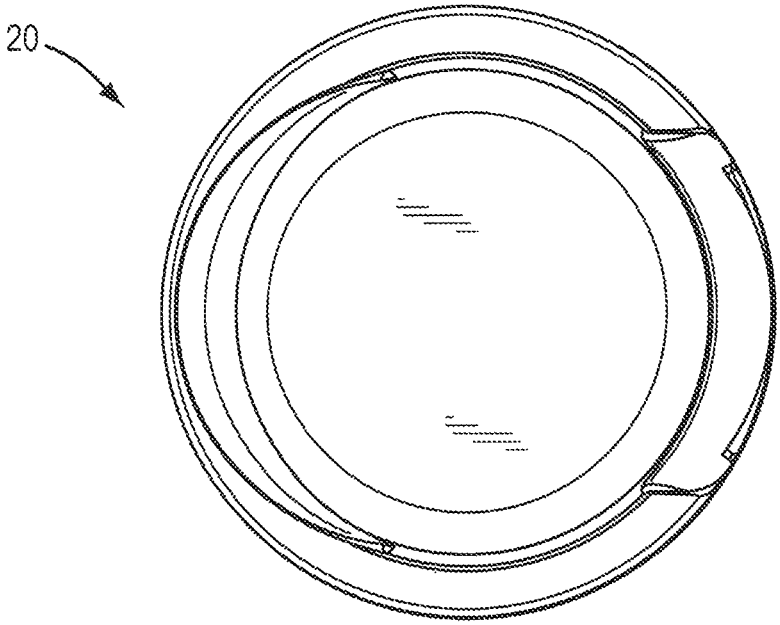
FIG. 3 is a top plan view of the first embodiment of the closed closure.
Figure 4:
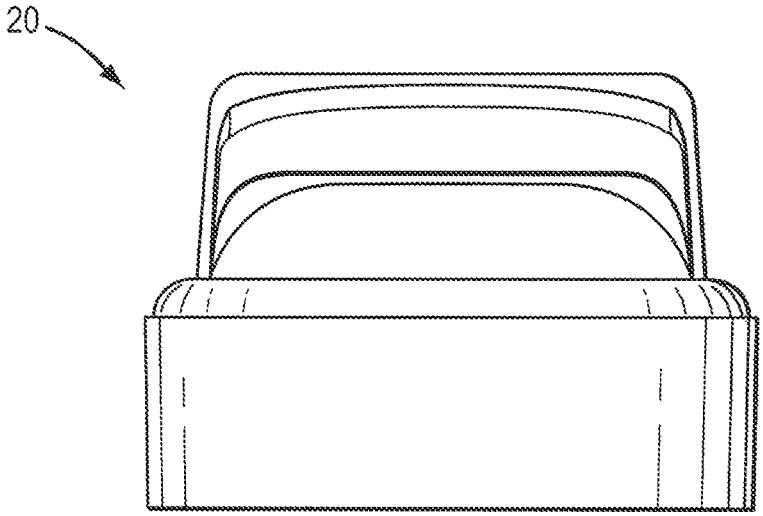
FIG. 4 is a front elevation view of the first embodiment of the closed closure.
Figure 5:
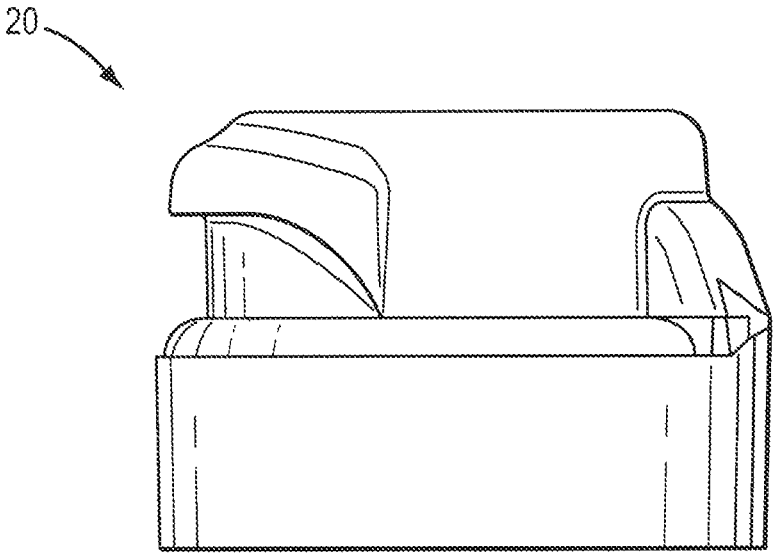
FIG. 5 is a right side elevational view of the first embodiment of the closed closure, the left side elevational view thereof being a mirror image.
Figure 6:
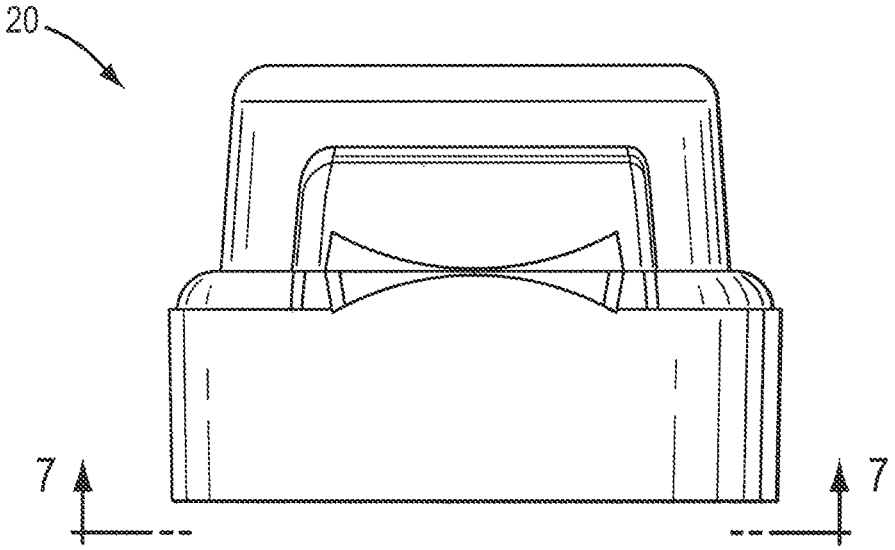
FIG. 6 is a rear elevational view of the first embodiment of the closed closure.
Figure 7:
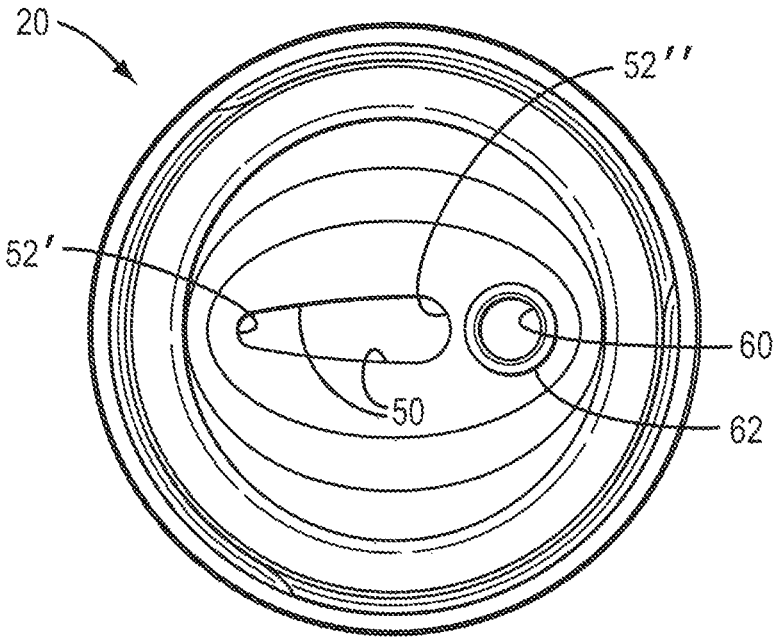
FIG. 7 is a bottom view of the first embodiment of the closed closure taken along the view line 7-7 in FIG. 6.

Extending downwardly from the periphery of the outer deck 42 is a skirt 44 for engaging the container (not shown) when the closure body 30 is mounted on the container. As can also be seen in FIG. 3, the skirt 44 of the closure body 30 defines an internal, female thread 46 for threadingly engaging a mating external, male thread (not shown) on the container (not shown) when the dispensing closure body 30 is installed on the container.

Alternatively, the closure body skirt 44 could be provided with some other container connecting means, such as a snap-fit bead or groove (not illustrated) for engaging a container neck groove or bead (not illustrated), respectively. The main part of the container may have a different cross-sectional shape than the container neck and closure body skirt 44. The closure body skirt 44 may have any suitable configuration for accommodating an upwardly projecting neck of the container (not shown) or for accommodating any other portion of a container received within the particular configuration of the closure body 30—even if a container does not have a neck, per se.

Also, the closure body skirt 44 could instead be permanently attached to the container by means of induction melting and bonding, ultrasonic melting and bonding, gluing, or the like, depending on materials used for the closure body skirt 44 and container. In another alternate design (not illustrated), the closure body skirt 44 could be formed (e.g., molded) as a unitary extension, or part, of the container.

In the illustrated first embodiment of the invention, the container-receiving opening defined by the closure body skirt 44 has a generally cylindrical configuration and includes the thread 46 that projects laterally inwardly. However, the closure body skirt 44 may have other configurations. For example, the closure body skirt 44 might have a prism or polygon configuration adapted to be mounted to the top of a container neck having a polygon configuration. Such prism or polygon configurations might not accommodate a threaded attachment, but other means of attachment could be provided, such as a snap-fit bead and groove arrangement, adhesive, or the like.

As can be seen in FIG. 11, the underside of the outer deck 42 is flat. However, if desired, the underside of the outer deck 42 could be provided with a conventional, flexible, "crab's claw" configuration seal (not shown) that would project downwardly from the underside of the outer deck 42 to seal against the annular top surface of the container. Other conventional or special seal features could, instead be provided to extend downwardly from the underside of the closure body outer deck 42. Such a seal could be a conventional "V" seal, or some other conventional or special seal, depending upon the particular application.

Figure 10:
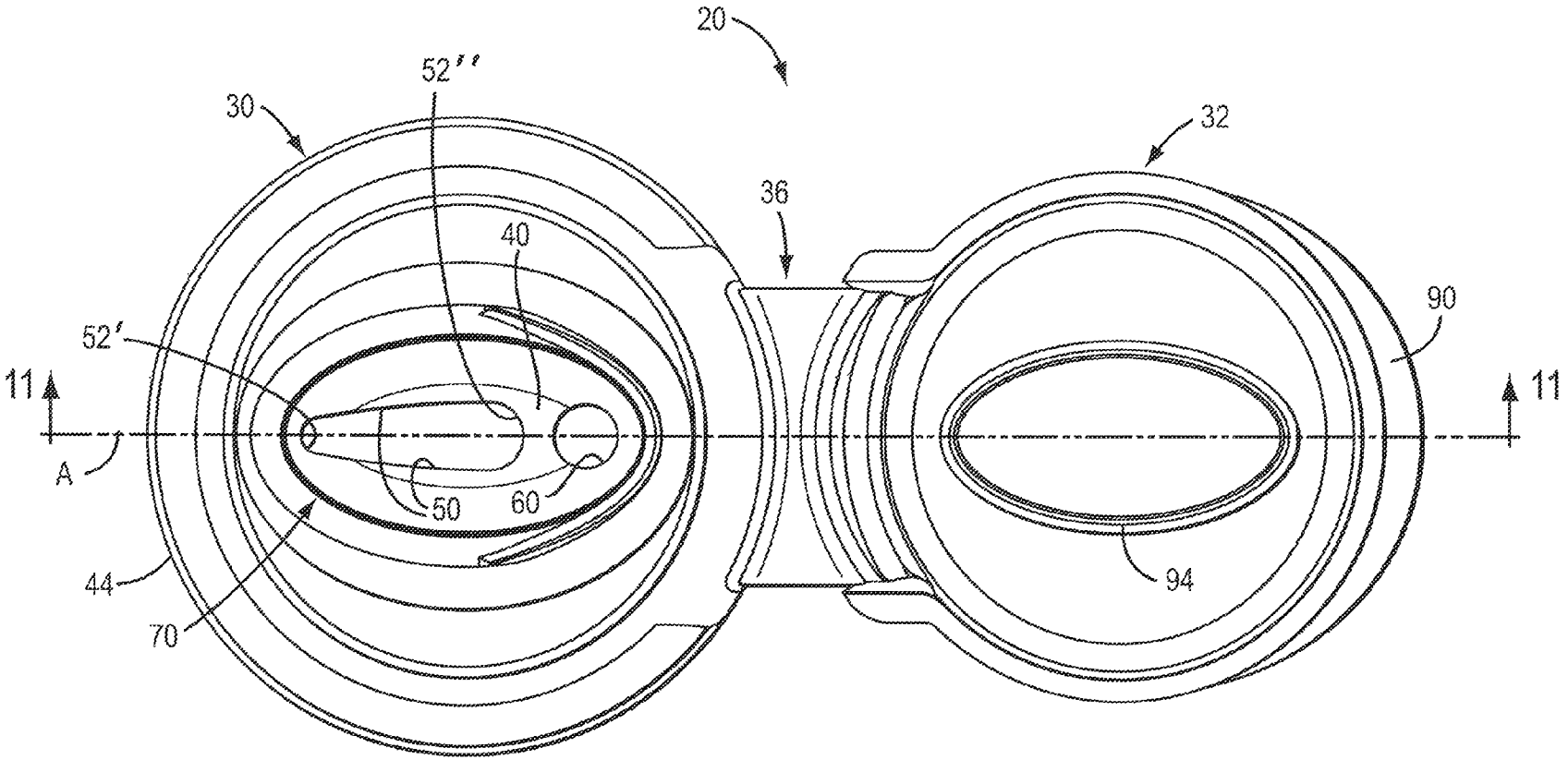
FIG. 10 is a top plan view of the first embodiment of the closure shown in the fully opened condition.

As can be seen in FIG. 10, the closure body inner deck 40 defines an elongate pour orifice or aperture 50. In the preferred embodiment illustrated in FIG. 10, the aperture 50 has an arcuate narrow end 52 and a wide end 52" that is wider than the narrow end 52'. The preferred shape of the pour aperture 50, although not a true ellipse, may be characterized as a narrow ovoid. In the preferred embodiment illustrated, the pour aperture 50 is oriented with its length along a central axis line A (FIG. 10) that bisects the pour aperture 50 and the closure body 30 (and also bisects the hinge 36 and lid 32). With reference to FIG. 10, the view line 11-11 lies on the central axis line.

As can be seen in FIG. 10, the closure body inner deck 40 also defines at least one vent aperture 60. In the illustrated preferred embodiment, there is only one vent aperture 60, and, preferably the vent aperture 60 is circular.

As can be seen in FIG. 11, below the inner deck 40, the vent aperture 60 is further defined by a downwardly extending vent tube 62 which is preferably cylindrical and which projects downwardly from the underside of the inner deck 40. As can be seen in FIG. 11, the distance that the vent tube 62 extends below the underside of the inner deck 40 is greater than the vent aperture 60 diameter. When the closure 20 is closed and installed on a container (not illustrated), the bottom of the vent tube 62 is received within the container opening and projects downwardly somewhat below the top of the container which is sealed against the underside of the closure body outer deck 42.

As can be seen in FIG. 10, the aperture 60 (and its associated, corresponding vent tube 62) is also preferably bisected by the closure body central axis line A. That is, the vent aperature 60 is preferably located with its center on the closure body central axis line A.

The pour aperture 50 and vent aperture 60 are arranged so that the pour aperture wide end 52" is located closer to the vent aperture 60 than is the pour aperture narrow end 52'. Also, the length of the pour aperture 50 as measured along the closure body central axis line A is preferably at least three times greater than the maximum width of the pour aperture 50 as the maximum width of the pour aperture 50 is measured along a line perpendicular to said closure body central axis line A.

Further, in the preferred embodiment illustrated in FIG. 10, the diameter of the vent aperture 60 is greater than the width of at least a portion of the pour aperture 50 (as the width of the pour aperture 50 is measured along a straight line that is perpendicular to the closure body central axis line A).

Further, in the preferred embodiment illustrated in FIG. 10, the vent aperture 60 is spaced away from the nearest portion of the pour aperture 50 by an amount that is less than the vent aperture 60 diameter.

In the preferred embodiment illustrated in FIG. 10, the length of the pour aperture 50 is greater than its greatest width as the width is measured on a straight line perpendicular parallel to the central axis line A. Preferably, the width of the pour aperture 50 continuously increases over a major portion of the length of the pour aperture 50 along the central axis line A.

As can be seen in FIG. 8, a pour spout 70 extends at least partway around the pour aperture 50. In the preferred embodiment illustrated, the pour spout 70 extends completely around the pour aperture 50 and the vent aperture 60. As can be seen in FIG. 11, the pour spout 70 includes a generally vertically oriented lower portion 72 rising above the deck 40. At the front of the spout 70, a pour lip 76 flares outwardly from the top of the lower portion 72. In plan view, the spout 70 defines a somewhat oval profile (FIG. 10).

In the preferred form of the invention, the lid 32 is provided to be closed over, and to cover, an upper part of the closure body 30. The lid 32 can be moved to expose the upper part of the closure body 30 to permit pouring out of the contents (i.e., product) through the pour aperture 50 from the container. The lid 32 is movable between (1) a closed position over the body 30 (as shown in FIGS. 1-6) sealing against the closure body 30 to prevent flow of the contents (i.e., product) outwardly of the closure body 30, and (2) an open position (as shown in FIGS. 8-11). In the preferred embodiment illustrated, the lid 32 is hinged to the closure body 30 by means of the hinge 36 so as to accommodate pivoting movement of the lid 32 between the closed position and the open position wherein the lid 32 pivots on a hinge pivot axis that is particular to the closure body central axis line A.

Figure 12:
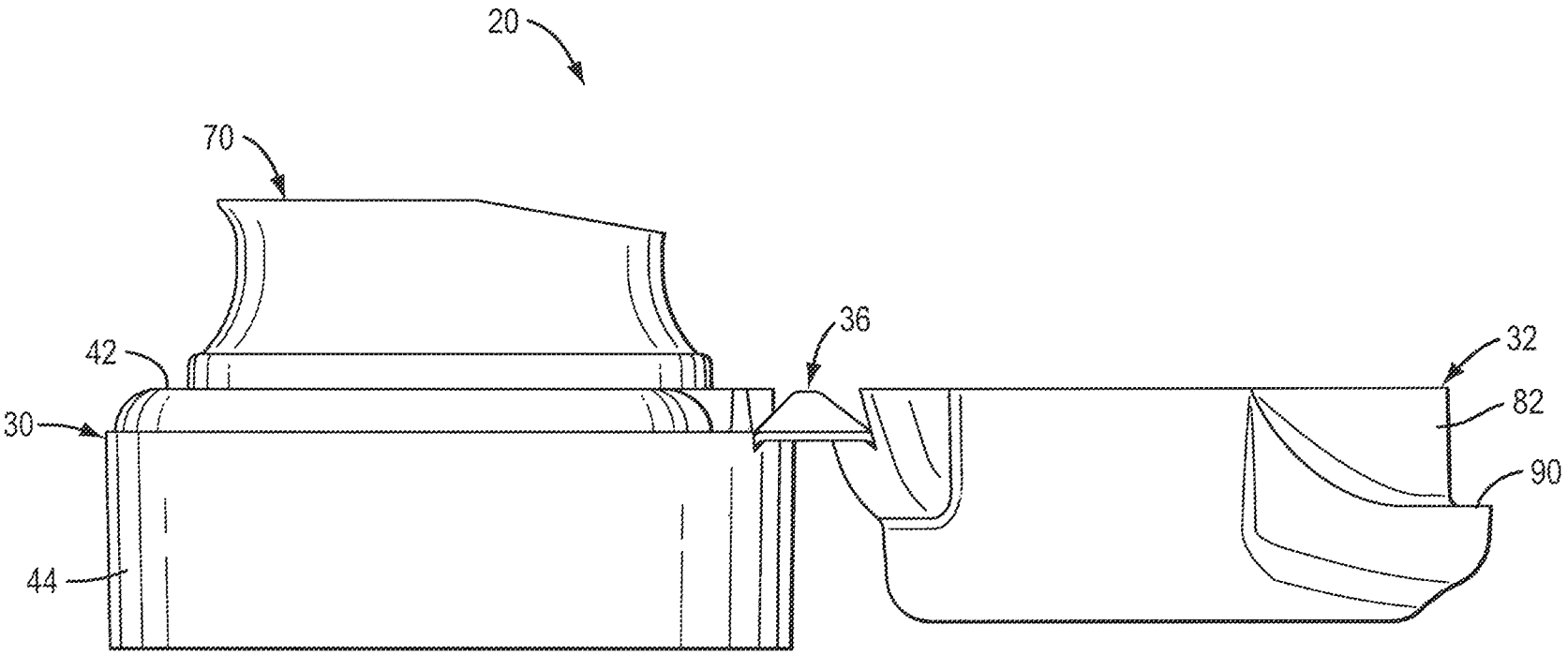
FIG. 12 is a side elevation view of the opened closure shown in FIG. 10.
Figure 13:
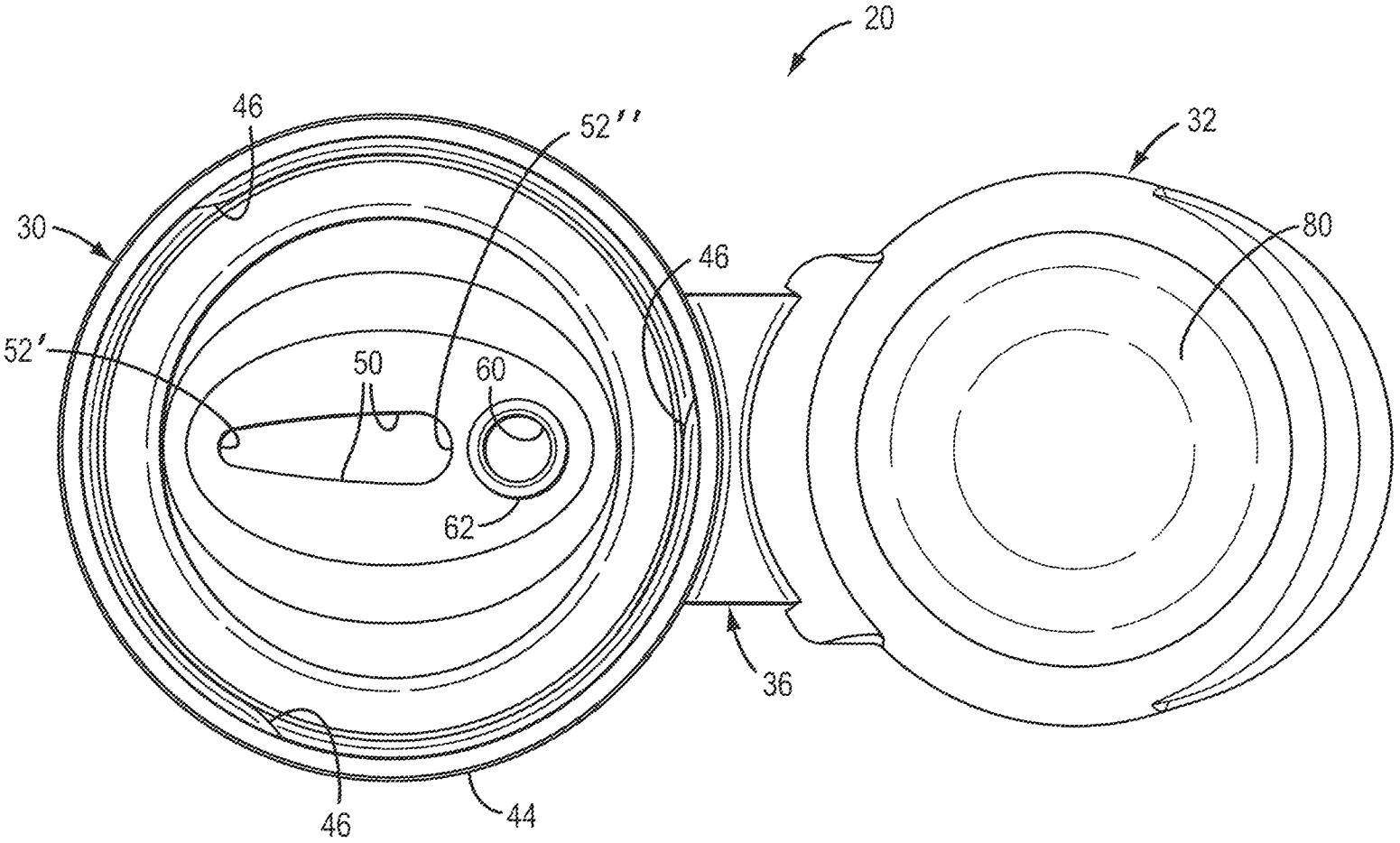
FIG. 13 is a bottom plan view of the opened closure shown in FIG. 13.

As seen in FIG. 11, the lid 32 includes a top end wall or cover 80 substantially surrounded by a peripheral lid flange 82. As seen in FIGS. 8, 11, and 12, the lid flange 82 has an end surface 88 for being received on, and abutting, the closure body outer deck 42 when the lid 32 is closed (FIG. 1).

In the illustrated embodiment, the closure hinge 36 is molded unitary with the lid flange 82 and with the closure body 30 so as to accommodate movement of the lid 32 between the open position exposing the closure spout 70, and the closed position sealing against the inside surface of the closure spout 70. The hinge 36 may be of any suitable conventional or special design. The hinge 36 may be a conventional snap-action type such as described in the U.S. Pat. No. 5,356,017, U.S. Pat. No. 5,642,824, or U.S. Pat. No. 6,321,923. The hinge could also be a non-snap-action type hinge, including a strap or tether. In yet other embodiments, the hinge could be a conventional two-piece hinge, such as a clip hinge, in which an axle could be provided on the lid 32 while a socket to receive that axle could be provided on the closure body 30. In some applications, the hinge (or any connection between the body 30 and lid 32) maybe omitted altogether.

A finger tab or thumb tab 90 (FIGS. 1, 9, and 11) may optionally be provided to project laterally outwardly at the front of the closure lid flange 82 to assist in lifting the lid 32 to the open position.

The lid 32 preferably also includes a hollow spud 94 (FIGS. 8, 9, and 11) for entering into the spout 70 of the closure body 30 when the lid 32 is closed. The spud 94 extends from lid end wall 80. In the preferred embodiment, the closure body spout 70 and the spud 94 each has a configuration for accommodating mating engagement when the lid 32 is closed, such as via sealing engagement of the spud 94 with the inside surface of the spout 70.

The configuration of the spout 70 facilitates the pouring of a fluent product (i.e., contents) from the container when the lid 32 is opened. When the lid 32 is closed, the spud 94 acts to contain the movement of the fluent product (i.e., contents) within the inside of the spout 70 so as to mitigate undesired movement of fluent product about the underside of the lid 32, and so as to prevent flow of the fluent product outwardly of the closure body spout 70 into the region between the exterior of the spout 70 and the lid flange 82.

Figure 14:
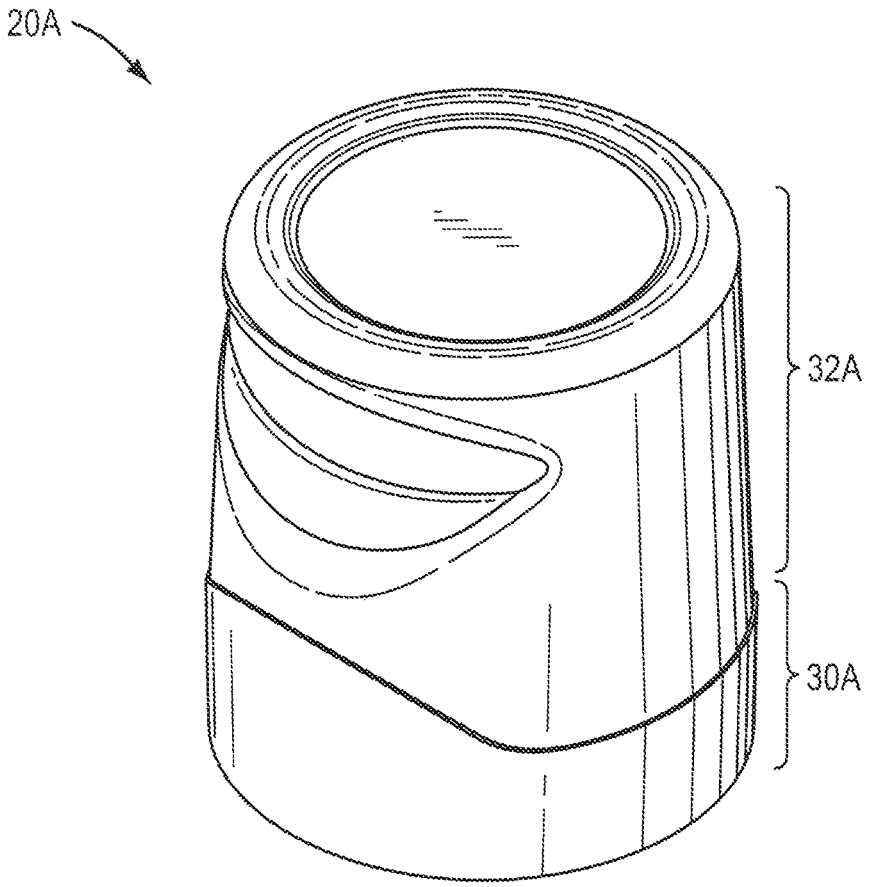
FIG. 14 is an isometric view, taken from the front and right side, of a second embodiment of the closure of the present invention shown in the closed condition.

FIG. 14 shows a second embodiment of a closure of the present invention wherein the second embodiment of the closure is designated generally by the reference number 20A. The second embodiment of the closure 20A is generally similar to the first embodiment of the closure 20 discussed above with reference to FIGS. 1-13. The second embodiment of the closure 20A shown in FIG. 14 differs from the first embodiment of the closure 20 in that the second embodiment of the closure 20A has a taller configuration. In particular, the closure 20A includes a lid 32A which is much taller than the lid 32 of the first embodiment of the closure 20 described above with reference to FIGS. 1-13, but the taller lid 32A is still adapted to close and open relative to a base 30A. This configuration of the closure 20A provides a completely different aesthetic exterior design of the closed closure compared to the aesthetic design of the first embodiment of the closed closure 20 described above with reference to FIGS. 1-13. The internal configuration of the second embodiment of the closure 20A is similar, and functionally analogous to, the internal configuration of the first embodiment of the closure 20 described above with reference to FIGS. 8-13.

Both closures 20 and 20A function in the same manner for closing a container and for being open to accommodate pouring of the container contents through the opened closure.

Advantageous features of both closures 20 and 20A will next be described with reference to FIGS. 1-13 illustrating the first embodiment of the closure 20. In particular, when the closure 20 is opened (FIGS. 8 and 10), a user can readily pour the contents from the container (not shown) out through the closure 20. With reference to FIG. 10, the closure 20 may be characterized as having a typical or normal pour orientation along the closure central axis line A. With reference to FIG. 10, a user typically would initially hold the container with the opened closure 20 on the top of the container and with the container oriented generally vertically (relative to the force of gravity). The user would then begin to tilt the container (with the opened closure 20 attached thereto) in alignment with the closure body central axis line A so as to cause the front of the closure body 30 (and its pour spout lip 76) to move downwardly while the rear of the closure body 30 and the opened lid 32 would remain higher than the spout lip 76. A sufficiently steep tilt will cause the contents from the container to flow out through the center portion of the pour aperture 50. Ambient atmospheric air can enter the vent aperture 60 to provide appropriate in-venting so as to assist in emptying the contents from the container through the opened closure 20.

The arrangement and configuration of the pour aperture 50 and the vent aperture 60 facilitate smooth pouring. The contents of the container can be relatively easily poured out with a generally consistent flow and ease of use regardless of the fill level in the container. The vent aperture vent tube 62 accommodates the return, or in-venting, of ambient atmospheric air into the container and past the outflowing contents.

The configuration of the pour aperture 50 and vent aperture 60 also minimizes undesirable "glugging" that can be experienced with some conventional closures wherein the flow of the contents out of a conventional closure is temporarily and periodically interrupted by in-flowing ambient atmospheric air.

The closure 20 performs especially well when used for pouring liquids having viscosities similar to that of some kinds of soy sauce. In the preferred embodiment illustrated in FIG. 10, the vent aperture 60 is relatively small so that it can prevent or inhibit undesirable flow of the contents through the vent apertures 60 but can still accommodate in-venting of the ambient atmospheric air.

The oval-shaped pour spout 70 which surrounds both the pour orifice 50 and vent aperture 60 provides a good flow "cutoff" at the spout lip 76 (FIG. 11) when the container and opened closure 20 are tilted back toward an upright orientation, and the spout 70 accommodates effective drainback of contents within the spout 70 back down through the pour aperture 50 and into the container.

It will be readily observed from the foregoing detailed description of the invention and from the illustrations thereof that numerous other variations and modifications may be effected without departing from the true spirit and scope of the novel concepts or principles of this invention.

What is claimed is:

1. A closure (20, 20A) for a container that has an opening to the container interior wherein contents may be stored, said closure (20, 20A) comprising:

(A) a body (30, 30A) that is either (a) a separate structure for being attached to said container at said opening, or (b) a structure formed as a unitary portion of said container at said opening, and wherein said closure body (30, 30A) has a deck (40) defining (i) a pour aperture (50) that can communicate with said container opening and that can accommodate pouring out of the contents through said pour aperture (50), and (ii) at least one vent aperture (60) that can communicate with said container opening and that can accommodate the in-venting of ambient atmosphere through said at least one vent aperture (60) into said container, and said closure body (30, 30A) has a pour spout (70) projecting outwardly from said deck (40) and extending at least partway around said pour aperture (50); and (B) a lid (32, 32A) for accommodating movement relative to said closure body (30, 30A) between (a) a closed position sealing against said closure body (30, 30A) to prevent flow of the contents outwardly of said closure body (30, 30A), and (b) an open position permitting flow of the contents outwardly of said closure body (30, 30A); and wherein said closure (20, 20A) is characterized in that said pour aperture (50) is elongate with its length oriented along a central axis line (A) that bisects said closure body (30) and said pour aperture (50);

said pour aperture (50) has an arcuate narrow end (52');

said pour aperture (50) has a wide end (52") that (i) is wider than said narrow end (52'), and (ii) is located closer to said at least one vent aperture (60) than is said narrow end (52');

said at least one vent aperture (60) has a maximum width as measured along a line perpendicular to said closure body central axis line (A), and said maximum width of said at least one vent aperture (60) is greater than the width of at least a portion of said pour aperture (50) as said pour aperture width is measured along a line perpendicular to said closure body central axis line (A); and said length of said pour aperture (50) is at least three time greater than the maximum width of said pour aperture (50) as the pour aperture maximum width is measured along a line perpendicular to said closure body central axis line (A).

2. The closure (20, 20A) in accordance with claim 1 in which the width of said pour aperture (50) continuously increases over a major portion of the length of the pour aperture (50) along said central axis line (A).

3. The closure (20, 20A) in accordance with claim 1 in which said wide end (52") of said pour aperture (50) is arcuate.

4. The closure (20, 20A) in accordance with claim 1 in which said closure (20, 20A) includes a hinge (36) connecting said closure body (30) and lid (32); and said central axis line (A) bisects said closure body (30), hinge (36), and lid (32).

5. The closure (20, 20A) in accordance with claim 1 in which in which said at least one vent aperture (60) is circular and is spaced away from the nearest portion of said pour aperture (50) by an amount that is less than the diameter of said at least one vent aperture (60).

6. The closure (20, 20A) in accordance with claim 1 in which said at least one vent aperture (60) is further defined by a downwardly extending vent tube (62) which projects downwardly from said deck (40);

said at least one vent aperture (60) is circular;

said vent tube (62) is cylindrical; and said at least one vent aperture tube (62) extends below said deck (40) by a distance which is greater than the diameter of the said at least one vent aperture (60).

7. The closure (20, 20A) in accordance with claim 1 in which said closure body (30) further includes a pour spout (70) that extends at least partway around said pour aperture (50).

8. The closure (20, 20A) in accordance with claim 7 in which said pour spout (70) extends completely around said pour aperture (50) and said at least one vent aperture (60); and said lid (32) includes a spud (94) for being received inside of, and sealingly engaged with, said spout (70) when said lid (32) is closed.

* * * * *